US008929801B2

(12) United States Patent
Ozawa

(10) Patent No.: US 8,929,801 B2
(45) Date of Patent: Jan. 6, 2015

(54) IMAGE FORMING DEVICE HAVING SHEET DISCHARGE GUIDE

(75) Inventor: Atsushi Ozawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 481 days.

(21) Appl. No.: 13/074,320

(22) Filed: Mar. 29, 2011

(65) Prior Publication Data

US 2012/0082496 A1 Apr. 5, 2012

(30) Foreign Application Priority Data

Sep. 30, 2010 (JP) ..... 2010-220881

(51) Int. Cl.
*G03G 15/00* (2006.01)
*B65H 29/70* (2006.01)

(52) U.S. Cl.
CPC ..... *G03G 15/6552* (2013.01)
USPC ..... 399/405; 399/406; 271/188

(58) Field of Classification Search
CPC ..... G03G 15/6573; G03G 15/6552; G03G 21/1633; B65H 29/70
USPC ..... 399/405, 68, 124, 406, 401; 271/292, 271/298, 188, 301–303, 161, 209, 225, 271/184–186, 902
See application file for complete search history.

(56) References Cited

U.S. PATENT DOCUMENTS 6,788,910 B2 * 9/2004 Kida ..... 399/124
7,920,819 B2 4/2011 Miyake
2009/0226199 A1 * 9/2009 Miyake ..... 399/68
2010/0225043 A1 * 9/2010 Otobe ..... 271/3.14
2010/0254740 A1 * 10/2010 Murata ..... 399/401

FOREIGN PATENT DOCUMENTS

| | | | |
|---|---|---|---|
| JP | H06-191686 | A | 7/1994 |
| JP | 07-036299 | | 2/1995 |
| JP | 08-314317 | | 11/1996 |
| JP | 2000-194209 | | 7/2000 |
| JP | 2001-048399 | | 2/2001 |
| JP | 2001-225993 | A | 8/2001 |
| JP | 2004-264648 | A | 9/2004 |
| JP | 2005-001787 | A | 1/2005 |
| JP | 2009-210822 | A | 9/2009 |

OTHER PUBLICATIONS

Office Action issued in corresponding Japanese Patent Application No. 2010-220881 dated Sep. 25, 2012.
Office Action issued in corresponding Japanese Patent Application No. 2010-220881 mailed Jun. 18, 2013.
Office Action received in corresponding Japanese Patent Application No. 2010-220881 mailed Feb. 12, 2014.

* cited by examiner

*Primary Examiner* — Ren Yan
*Assistant Examiner* — Justin Olamit
(74) *Attorney, Agent, or Firm* — Banner & Witcoff, Ltd.

(57) ABSTRACT

An image forming device including a main frame, a fixing unit, and a sheet discharge guide. The main frame is formed with a sheet discharge opening. The fixing unit includes a heat member and a pressure member providing a nip portion in cooperation with the heat member to fix a developing agent image onto a sheet at the nip portion. The sheet discharge guide provides a generally U-shaped guide surface configured to turn around the sheet discharged from the fixing unit toward the sheet discharge opening. The sheet discharge guide is displaceable toward and away from the nip portion between a non displaced state and a displaced state. The sheet discharge guide is configured to guide the sheet toward the sheet discharge opening at the non displaced state and the displaced state.

10 Claims, 4 Drawing Sheets

IMAGE FORMING DEVICE HAVING SHEET DISCHARGE GUIDE

CROSS REFERENCE TO RELATED APPLICATION

This application claims priority from Japanese Patent Application No. 2010-220881 filed Sep. 30, 2010. The entire content of the priority application is incorporated herein by reference.

TECHNICAL FIELD

The present invention relates to an image forming device having a thermal fixing unit that thermally fixes a toner image onto a sheet upon heating the sheet.

BACKGROUND

An image forming device is provided with a thermal fixing unit and a U-shaped sheet guide. The thermal fixing unit includes a heat roller and a pressure roller nipping a sheet therebetween for thermally and pressurizingly fixing a toner image onto the sheet. Here, toner is a developing agent. The sheet guide is adapted to guide the sheet discharged from the thermal fixing unit to a sheet discharge opening positioned higher than the thermal fixing unit so as to turn around the sheet.

Conventionally, the sheet heated at and discharged out of the fixing unit may be curled in a sleeve like or a rainwater guttering fashion whose axial direction is coincident with a sheet feeding direction. One example to avoid such sheet curl is disclosed in Japanese Patent Application Publication No. 2001-48399.

SUMMARY

The present disclosure provides an image forming device including a main frame, a thermal fixing unit, and a sheet discharge guide. The main frame provides an internal space and is formed with a sheet discharge opening. The thermal fixing unit is provided in the internal space and includes a heat member, and a pressure member providing a nip portion in cooperation with the heat member to fix a developing agent image onto a sheet at the nip portion. The sheet discharge guide provides a generally U-shaped guide surface configured to turn around the sheet discharged from the fixing unit toward the sheet discharge opening. The sheet discharge guide is displaceable toward and away from the nip portion between a non displaced state and a displaced state. The sheet discharge guide is configured to guide the sheet toward the sheet discharge opening at the non displaced state and the displaced state.

The present disclosure further provides an image forming device includes a main frame, a thermal fixing unit, and a sheet discharge guide. The main frame provides an internal space and is formed with a sheet discharge opening. The thermal fixing unit is provided in the internal space and includes a heat member, and a pressure member providing a nip portion in cooperation with the heat member to fix a developing agent image onto a sheet at the nip portion. The sheet discharge guide provides a generally U-shaped guide surface configured to turn around the sheet discharged from the fixing unit toward the sheet discharge opening. The sheet discharge guide is displaceable toward and away from the nip portion between a non displaced state and a displaced state. The sheet discharge guide is configured to guide the sheet toward the sheet discharge opening at the non displaced state and the displaced state.

BRIEF DESCRIPTION OF THE DRAWINGS

In the drawings:

FIG. 2(*b*) is a schematic view for description of a positioning mechanism for positioning the sheet discharge guide in the laser printer according to the first embodiment;

FIG. 4(*b*) is a partial perspective view of the sheet discharge guide in the laser printer according to the second embodiment and showing an inward position of the second guide; and, FIG. 4(*c*) is a schematic view for description of a positioning mechanism for positioning the sheet discharge guide in the laser printer according to the second embodiment.

DETAILED DESCRIPTION

Figure 1:
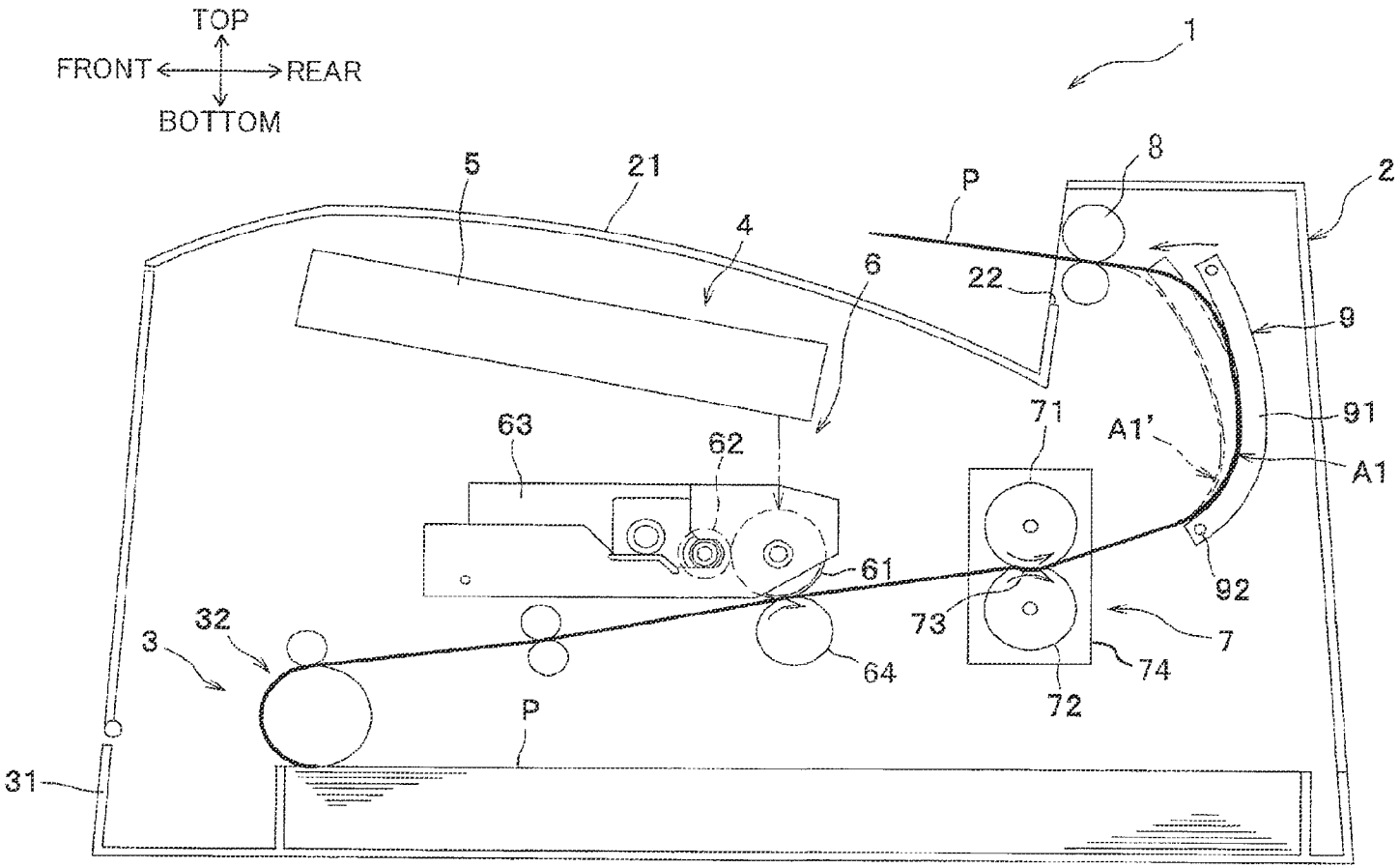
FIG. 1 is a schematic side view of a laser printer according to a first embodiment of the present invention.

An image forming device according to a first embodiment will be described with reference to FIGS. 1 through 2(*b*). A laser printer 1 is a typical example of the image forming device. Throughout the description, the terms "upward", "downward", "upper", "lower", "above", "below", "beneath", "right", "left", "front", "rear" and the like will be used assuming that the laser printer is disposed in an orientation in which it is intended to be used. In FIG. 1, a left side and a right side are a front side and a rear side of the printer 1, respectively.

As shown in FIG. 1, the laser printer 1 includes a main frame 2 made from a resin, a feeder unit 3 for supplying a sheet P as an image recording medium, and an image forming unit 4 for forming an image in the sheet fed from the feeder unit 3. The main frame 2 is formed with a sheet discharge opening 22, and has an upper region functioning as a sheet discharge tray 21.

The feeder unit 3 includes a sheet supply tray 31 provided detachable from a bottom portion of the main frame 2, and a sheet supplying mechanism 32 for supplying a sheet P in the sheet supply tray 31 toward the image forming unit 4.

The image forming unit 4 includes a scanner unit 5, a process cartridge 6, a transfer roller 64, and a thermal fixing unit 7, those positioned in the main frame 2. The scanner unit 5 is positioned at an upper portion within the main frame 2 and includes a laser emitting portion, a polygon mirror, a lens and a reflection mirror those not shown.

The process cartridge 6 is detachable relative to the main frame 2 and includes a photosensitive drum 61, a developing roller 62, and a toner container 63 for accommodating a toner (developing agent) therein. A charger is provided for uniformly charging a surface of the rotating photosensitive drum 61. The scanner unit 5 is adapted to irradiate laser beam at high scanning speed onto surface of the photosensitive drum 61 based on image data after the surface is charged by the charger. Electric potential at a region exposed to the laser beam will be lowered, so that an electrostatic latent image based on the image data is formed on the surface of the photosensitive drum 61.

The developing roller 62 is adapted to supply toner accommodated in the toner container 63 onto the surface of the photosensitive drum 61 to form a visible toner image corresponding to the electrostatic latent image. The transfer roller 64 is adapted for transferring the toner image on the photosensitive drum 61 onto the sheet P when the sheet P passes between the photosensitive drum 61 and the transfer roller 64.

The fixing unit 7 includes a heat roller 71 as a heating member for heating the sheet P, a pressure roller 72 as a pressure member for providing a nip portion 73 in cooperation with the heat roller 71, and a casing 75 rotatably supporting the heat roller 71 and the pressure roller 72. The fixing unit 7 is adapted to thermally fix the toner image to the sheet P when the sheet P passes through the nip portion 73.

A sheet discharge roller 8 is provided immediately upstream of the sheet discharge opening 22 for discharging the sheet onto the discharge tray 21 therethrough. A sheet discharge guide 9 is provided between the fixing unit 7 and the sheet discharge roller 8. The sheet discharge guide 9 has a generally U-shaped configuration so as to turn around the sheet P fed from the fixing unit 7 to the sheet discharge opening 22 positioned higher than the fixing unit 7. That is, the sheet discharged rearward from the fixing unit 7 is turned frontward by the sheet discharge guide 9.

Next, the sheet discharge guide 9 and a structure associated therewith will be described in detail. The sheet discharge guide 9 is generally arcuate shaped in a side view for guiding a travel of the sheet P toward the discharge opening 22. That is, generally U-shaped or C-shaped sheet passage is provided by the sheet discharge guide 9.

Figure 2A:
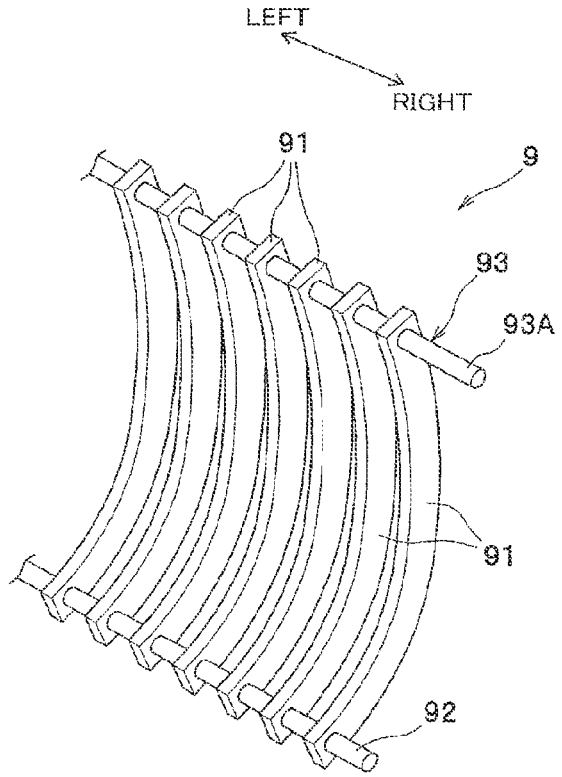
FIG. 2(*a*) is a partial perspective view of a sheet discharge guide in the laser printer according to the first embodiment.
Figure 2B:
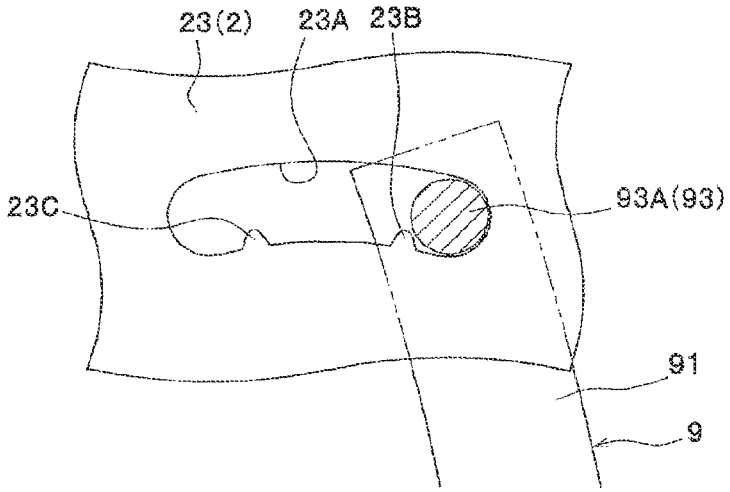

As shown in FIG. 2(*a*), the discharge guide 9 includes a plurality of guide members 91, a pivot shaft 92 connecting together each lower end portion of each guide member 91, and a linking shaft 93 connecting together each upper end portion of each guide member 91. In FIG. 2(*a*) a left portion of the discharge guide 9 is not shown, but only a right portion thereof is shown.

The guide members 91 are of arcuate shape in side view, and are spaced away from each other in a lateral direction (widthwise direction of the sheet P). A radius of curvature of a base end portion of the guide member 91 is smaller than that of a remaining portion thereof. The pivot shaft 92 has axially end portions rotatably supported to the main frame 2. Thus, the guide members 91 are pivotally movable about an axis of the pivot shaft 92 such that upper free end portions of the guide members 91 are movable frontward and rearward. In other words, the discharge guide 9 is displaceable toward and away from the nip portion 73, and configured to direct the sheet discharged from the fixing unit 7 toward the discharge opening 22 at the frontward and rearward displaced positions of the discharge guide 9.

More specifically, the discharge guide 9 is pivotally movable between a remote position spaced away from the nip portion 73 by a predetermined distance as shown by a solid line in FIG. 1 and a proximal position adjacent to the nip portion 73 as shown by a two dotted chain line in FIG. 1. The proximal position can provide higher degree of normal curling of the sheet discharged from the fixing unit 7 rather than the remote position in order to correct or cure the sleeve like curl. Here, "higher degree of normal curling" implies that a minimum radius of curvature A1' of the sheet P provided by the proximal position is smaller than a minimum radius of curvature A1 of the sheet P provided by the remote position.

Since the degree of normal curling can be changed by displacing the discharge guide 9 toward and away from the nip portion 73, the sleeve-like curl can be corrected or cured while reducing load to the sheet P. Further, mechanically simple discharge guide can be provided by the pivotally supporting structure of the discharge guide 9 to the main frame 2 rather than a sliding structure of a discharge guide.

Further, as shown in FIG. 2(*a*), the linking shaft 93 has an axial length greater than that of the pivot shaft 92 such that at least one axial end portion 93A of the linking shaft 93 is positioned outward of the pivot shaft 92 in the axial direction. The main frame 2 has a side wall 23 formed with at least one arcuate slot 23A through which the axial end portion 93A of the linking shaft 93 extends outward for access to an operator. A center of a radius of a curvature of the arcuate slot 23A is coincident with the axis of the pivot shaft 92. The slot 23A has a first protrusion 23B for holding the one axial end portion 93A to maintain the remote position, and has a second protrusion 23C for holding the one axial end portion 93A to maintain the proximal position. With this structure, the operator can feel a sense of click when the operator moves the axial end portion 93A past the protrusion 23B or 23C. Thus, the discharge guide 9 can be stably positioned at either one of the remote position and proximal position.

Figure 3:
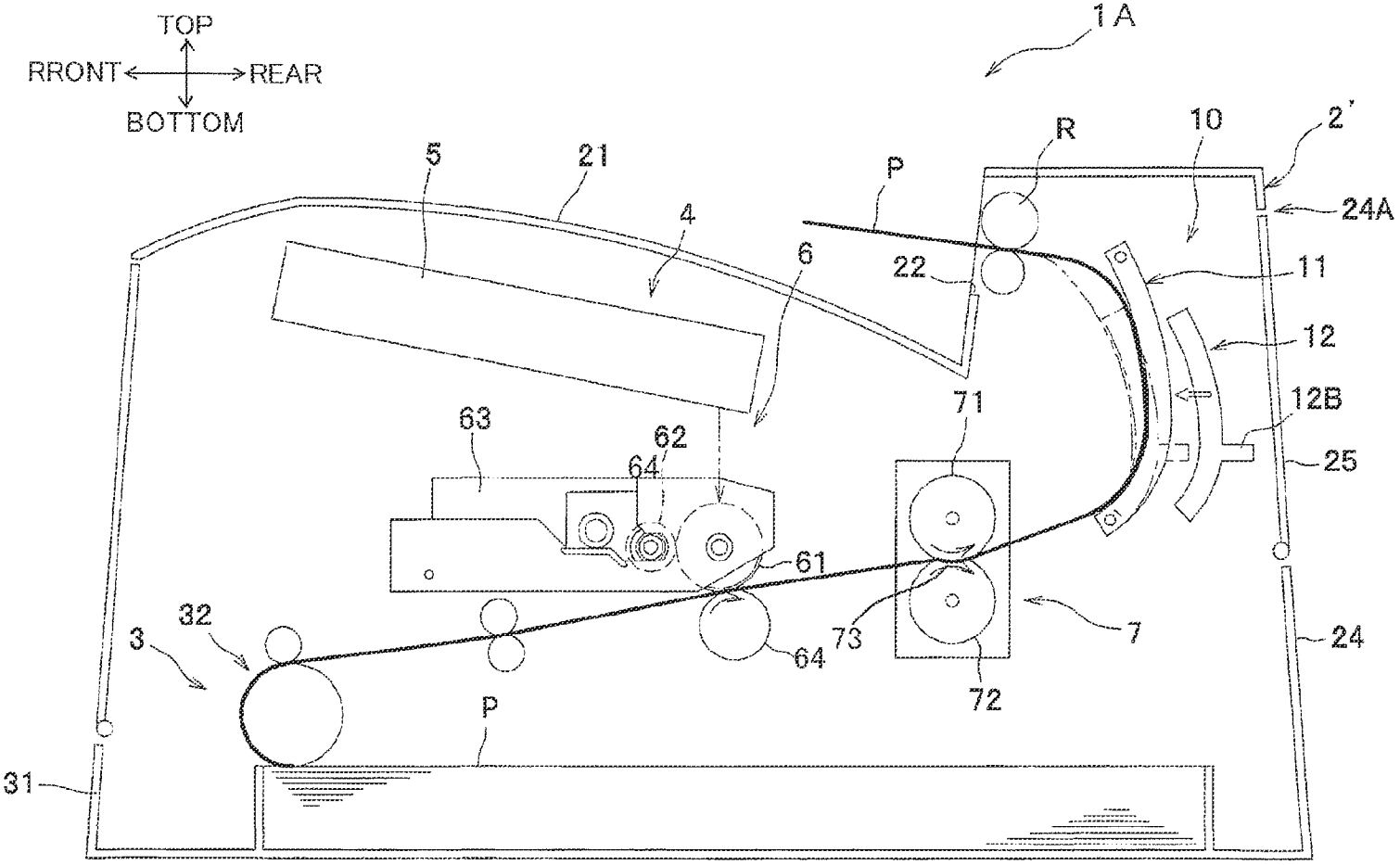
FIG. 3 is a schematic side view of a laser printer according to a second embodiment of the present invention.

An image forming device 1A according to a second embodiment will next be described with reference to FIGS. 3 through 4(*b*). Instead of the pivotable discharge guide 9 in the first embodiment, the second embodiment has a discharge guide 10 including a fixed first guide 11 and a movable second guide 12 such that the second guide 12 is movable in frontward/rearward direction between a front position in front of the first guide 11 and a rear position behind the first guide 11. With this structure, a degree of normal curl can also be changed.

The first guide 11 includes a plurality of first arcuate members 11A and two linking shafts 11B, 11B connecting together each upper end portion and each lower end portion of the arcuate members 11A, respectively. In FIGS. 4(*a*) and 4(*b*), a left portion of the discharge guide 10 is not shown, but only a right portion thereof is shown.

Each of the first arcuate members 11A has a lower portion having a first radius of curvature which is smaller than that of the remaining portion of each first arcuate member 11A. Further two linking shafts 11B extend laterally and spaced away from each other and each first arcuate member 11A is integrally connected to the two linking shafts 11B while a space is provided between the neighboring first arcuate members 11A in the lateral direction. Each axially end portion of each linking shaft 11B is fixed to the main frame 2'. Thus, the first guide 11 is fixedly supported to the main frame 2'.

The second guide 12 includes a plurality of second arcuate members 12A and a linking member 12B linking integrally with the plurality of second arcuate members 12A. Each of the second arcumate members 12A has a lower portion having a second radius of curvature which is smaller than that of the remaining portion of each second arcuate member 12A. Further, second radius of curvature is smaller than the first radius of curvature. Each second arcuate member 12A is integrally connected to the linking member 12B while a space is provided between the neighboring second arcuate members 12A in the lateral direction.

The linking member 12B includes a plurality of first portions 12B1 each extending rearward from each second arcuate member 12A, a second portion 12B2 extending in the lateral direction for integrally linking each rear end of each first portions 12B1, and a pair of slider portions 12B3. One of the slider portions 12B3 extends outwardly from a rightmost first portion 12B1 in the lateral direction, and the other slider portion 12B3 extends outwardly from a leftmost first portion 12B1 in the lateral direction.

Figure 4A:
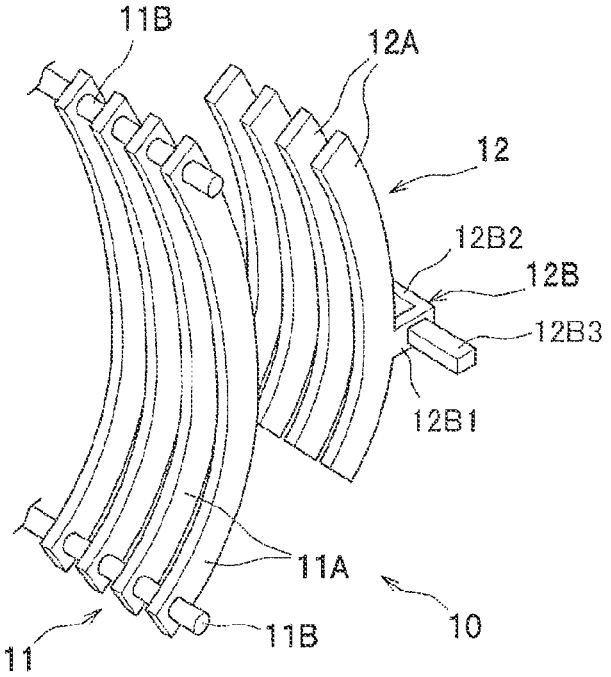
FIG. 4(*a*) is a partial perspective view of a sheet discharge guide including a first guide and a second guide in the laser printer according to the second embodiment and showing an outward position of the second guide.
Figure 4B:
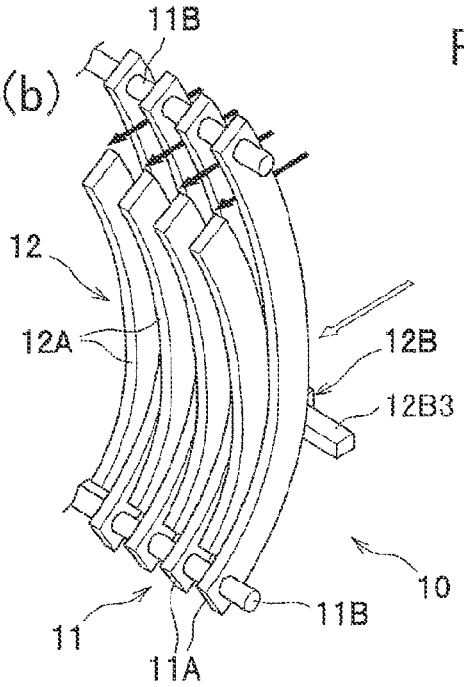
Figure 4C:
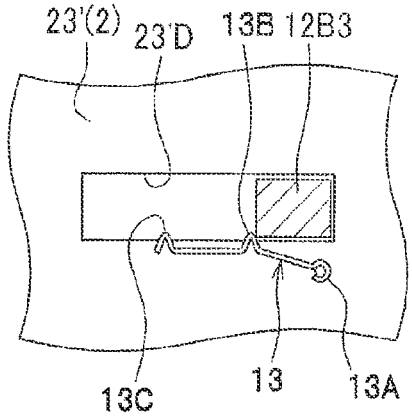

As shown in FIG. 4(*c*), the main frame 2' has a pair of side walls 23'. A rectangular recess 23'D extending in a frontward/rearward direction is formed in an inner surface of each side wall 23'. Further, each free end of each slider portion 12B3 is in sliding contact with each recess 23'D. These recesses 23'D, the first guide 11 and the second guide 12 are so positioned such that the second guide 12 is movable between an inward position as shown by a two dotted chain line in FIG. 3 where the second guide 12 is positioned closer to the fixing unit 7 than the first guide 11 to the fixing unit 7 and an outward position as shown by a solid line in FIG. 3 where the second guide 12 is positioned farther from the fixing unit 7 than the first guide 11 from the fixing unit 7. A combination of the slider portion 12B3 and the recesses 23'D constitute a change-over mechanism for selectively positioning the second guide 12 to either the inward position or outward position.

In the second embodiment, each slider portion 12B3 is not accessible by an operator from an outside of the side wall 23' to avoid accentual access to the slider portion 12B3. Instead, as shown in FIG. 3, the main frame 2' has a rear wall 24 formed with a rear opening 24A, and a rear cover 25 pivotally movably supported to the rear wall 24 for covering the rear opening 24A. Thus, second portion 12B of the second guide 12 is accessible by an operator after opening the rear cover 25 and revealing the rear opening 24A. That is, the operator can grip the second portion 12B to move the second guide 12.

As shown in FIG. 4(*c*), an urging member 13 such as a wire spring and a leaf spring is supported to the inner surface of the side wall 23' at a position adjacent to the recess 23'D. The urging member 13 has a base end portion 13A pivotally movably supported to the side wall 23', and an arm portion provided with protrusions 13B and 13C protrudable into and retractable from a locus of the slider portion 12B3. Engagement of the slider portion 12B3 with the protrusion 13B or 13C will provide a sense of click to the operator, and stabilizes positioning of the second guide 12 at either the inward or outward position.

Thus, according to the second embodiment, the sheet that has been curled in a sleeve or a rainwater guttering fashion can be subjected to shape correction by the curvature of the second guide 12, when the second guide 12 is moved to the inward position for moving the sheet along the surface of the second guide 12. This explanation is also applicable to the first embodiment.

Various modifications are conceivable. For example, the above-described embodiments are also available for the image forming device other than the laser printer, such as a copying machine and a multi-function device.

Further, in the fixing unit 7, instead of the heat roller 71, a tubular flexible film circularly movably supported by a pair of guides can be used.

Further, in the fixing unit 7, instead of the pressure roller 72, a belt-like pressure member is also available. Further, the sheet P can be any one of a thick paper, a postcard, a thin paper, and an OHP sheet or the like.

Further, instead of the discharge guide 9 including a plurality of guide members 91, a single plate-like member or an arcuate plate member having a predetermined thickness can be used as the discharge guide.

Further, instead of the discharge guide 9 or the second guide 12 movable in the frontward/rearward direction, an immovable guide may also be available. The immovable guide may be provided by a plate member that is resiliently bendable or flexible, so that the degree of normal curl can be changed by changing the bending degree of the plate member. In other words, bending deformation of the immovable guide can displace a part of the immovable guide toward and away from the nip portion.

While the invention has been described in detail with reference to the specific embodiments thereof, it would be apparent to those skilled in the art that various changes and modifications may be made therein without departing from the scope of the invention.

What is claimed is:

1. An image forming device comprising:

a main frame providing an internal space and formed with a sheet discharge opening;

a fixing unit provided in the internal space and comprising a heat member, and a pressure member providing a nip portion in cooperation with the heat member; and a sheet discharge guide provided with a U-shaped part having one side and another side, the one side being a depressed guide surface configured to contact and guide a sheet to make a U-turn from the fixing unit toward the sheet discharge opening, the sheet discharge guide being displaceable toward and away from the nip portion between a non-displaced state and a displaced state, the depressed guide surface being configured to contact and guide the sheet toward the sheet discharge opening in the non-displaced state and the displaced state, wherein the sheet discharge guide comprises a first guide fixed to the main frame and a second guide movable relative to the first guide between a first position and a second position, wherein, when the second guide is positioned in the first position, the second guide is positioned closer to the nip portion than the first guide, and, when the second guide is positioned in the second position, the second guide is positioned farther from the nip portion than the first guide, wherein the sheet discharge opening is positioned higher than the fixing unit, wherein the first guide has an arcuate shape and includes a first portion with a first radius of curvature, and wherein the second guide has an arcuate shape and includes a second portion with a second radius of curvature different from the first radius of curvature.

2. The image forming device as claimed in claim 1, wherein the second radius of curvature is smaller than the first radius of curvature.

3. The image forming device as claimed in claim 1, wherein the first guide comprises a plurality of first arcuate members arrayed side by side and spaced away from each other in a widthwise direction of the sheet and connected with each other, each of the first arcuate members having the first radius of curvature, and wherein the second guide comprises a plurality of second arcuate members arrayed side by side and spaced away from each other in the widthwise direction of the sheet and connected with each other, each of the second arcuate members having the second radius of curvature.

4. The image forming device as claimed in claim 3, further comprising a mechanism configured to maintain the second guide at one of the first position and the second position.

5. The image forming device as claimed in claim 1, wherein the depressed guide surface is configured to contact and guide the sheet toward the sheet discharge opening in the non-displaced state and the displaced state such that a minimal radius of the sheet at the depressed guide surface when the sheet discharge opening is in the non-displaced state is smaller than a minimum radius of the sheet at the depressed guide surface when the sheet discharge opening is in the displaced state.

6. An image forming device comprising:

a main frame providing an internal space and formed with a sheet discharge opening;

a fixing unit provided in the internal space and comprising a heat member, and a pressure member providing a nip part in cooperation with the heat member; and a sheet discharge guide having a U-shape, the sheet discharge guide providing a depressed guide surface and an opposite surface opposite the depressed guide surface, the depressed guide surface configured to contact and turn around a sheet transported from the fixing unit toward the sheet discharge opening, wherein the sheet discharge guide comprises a first guide fixed to the main frame, and a second guide, wherein the second guide is slidably movable relative to the first guide between a first position and a second position, and wherein, when the second guide is positioned in the first position, the second guide is closer to the nip part than the first guide, and, when the second guide is positioned in the second position, the second guide is farther from the nip part than the first guide, wherein the first guide includes a first U-shaped part having one side and another side, the one side being a depressed guide surface, wherein the one side of the first U-shaped part is configured to contact and guide the sheet to make a U-turn from the fixing unit toward the sheet discharge opening when the second guide is positioned in the second position, wherein the second guide includes a second U-shaped part having one side and another side, the one side being a depressed guide surface, and wherein the one side of the second U-shaped part is configured to contact and guide the sheet to make a U-turn from the fixing unit toward the sheet discharge opening when the second guide is positioned in the first position.

7. The image forming device according to claim 6, wherein the second guide is slidably movable relative to the first guide between the first position and the second position in a moving direction, wherein the second guide includes a U-shaped part and a slider part extending outwardly in a widthwise direction, wherein the main frame is formed with a recess extending in the moving direction, and wherein the slider part slidably contacts with the recess such that second guide slidably moves in the moving direction.

8. The image forming device as claimed in claim 6, wherein the sheet discharge opening is positioned higher than the fixing unit, wherein the first guide has an arcuate shape and having a first portion with a first radius of curvature, and wherein the second guide has an arcuate shape and having a second portion with a second radius of curvature different from the first radius of curvature.

9. The image forming device as claimed in claim 8, wherein the second radius of curvature is smaller than the first radius of curvature.

10. The image forming device as claimed in claim 8, wherein the first guide comprises a plurality of first arcuate members arrayed side by side and spaced away from each other in a widthwise direction of the sheet and connected with each other, each of the first arcuate members having the first radius of curvature, and wherein the second guide comprises a plurality of second arcuate members arrayed side by side and spaced away from each other in a widthwise direction of the sheet and connected with each other, each of the second arcuate members having the second radius of curvature.

* * * * *